US009943954B2

(12) United States Patent
Bryant

(10) Patent No.: US 9,943,954 B2
(45) Date of Patent: Apr. 17, 2018

(54) WORKBENCH ARRANGEMENT ADAPTED TO BE IN PART SUPPORTABLE BY A WHEELIE BIN

(71) Applicant: Paul Bryant, New South Wales (AU)

(72) Inventor: Paul Bryant, New South Wales (AU)

( * ) Notice: Subject to any disclaimer, the term of this patent is extended or adjusted under 35 U.S.C. 154(b) by 49 days.

(21) Appl. No.: 14/900,295

(22) PCT Filed: Jun. 27, 2014

(86) PCT No.: PCT/AU2014/000663
§ 371 (c)(1),
(2) Date: Dec. 21, 2015

(87) PCT Pub. No.: WO2014/205492
PCT Pub. Date: Dec. 31, 2014

(65) Prior Publication Data

US 2016/0368130 A1 Dec. 22, 2016

(30) Foreign Application Priority Data

Jun. 28, 2013 (AU) ..... 2013902398

(51) Int. Cl.

| | |
|---|---|
| ***A47B 5/00*** | (2006.01) |
| ***B25H 1/04*** | (2006.01) |
| ***B65F 1/14*** | (2006.01) |
| ***A47B 1/04*** | (2006.01) |
| ***A47B 3/06*** | (2006.01) |
| ***A47B 9/18*** | (2006.01) |
| ***A47B 9/20*** | (2006.01) |
| ***A47B 13/00*** | (2006.01) |

(Continued)

(52) U.S. Cl.
CPC ..... *B25H 1/04* (2013.01); *A47B 1/04* (2013.01); *A47B 3/06* (2013.01); *A47B 9/18* (2013.01); *A47B 9/20* (2013.01); *A47B 13/003* (2013.01); *A47B 13/02* (2013.01); *A47B 13/088* (2013.01); *B25H 3/04* (2013.01); *B65D 25/24* (2013.01); *B65D 43/16* (2013.01); *B65F 1/14* (2013.01)

(58) Field of Classification Search
CPC ..... A47B 1/04; A47B 5/06; A47B 83/045
USPC ..... 108/48, 64, 65, 134, 135, 152, 155, 108/157.1, 157.16; 312/277, 281, 282
See application file for complete search history.

(56) References Cited

U.S. PATENT DOCUMENTS 1,048,596 A * 12/1912 Sedaj ..... A47B 1/04 108/69
2,555,217 A * 5/1951 Young ..... B23D 47/025 144/286.1

(Continued)

*Primary Examiner* — Matthew W Ing
(74) *Attorney, Agent, or Firm* — Renner Kenner Greive Bobak Taylor & Weber

(57) ABSTRACT

A workbench arrangement supportable by a wheelie bin having a worktop with a base portion with dimensions for a frictional fit engagement with upper internal walls of a lid removed opening of a wheelie bin to be laterally fixable in the opening of the wheelie bin. The worktop further including an outer skirt adapted to rest upon a peripheral upper edge of the lid removed opening of the wheelie bin to support the worktop in an elevated flat user workable position. A worktop table extension adapted to laterally join with the outer skirt of the worktop to support the worktop table extension at one end and at least one support leg fastenable at the other end to support the worktop table extension in the elevated flat user workable position.

15 Claims, 13 Drawing Sheets

(51) Int. Cl.

| | |
|---|---|
| ***A47B 13/02*** | (2006.01) |
| ***A47B 13/08*** | (2006.01) |
| ***B25H 3/04*** | (2006.01) |
| ***B65D 25/24*** | (2006.01) |
| ***B65D 43/16*** | (2006.01) |

(56) References Cited

U.S. PATENT DOCUMENTS

| | | | | | |
|---|---|---|---|---|---|
| 2,580,618 | A * | 1/1952 | Terrell | A47B 5/06 | 108/134 |
| 2,587,469 | A * | 2/1952 | Herring | A47B 21/02 | 108/116 |
| 4,321,873 | A * | 3/1982 | Nealis | A47B 87/005 | 108/101 |
| 5,114,265 | A * | 5/1992 | Grisley | B27F 1/12 | 144/144.1 |
| 6,199,489 | B1 * | 3/2001 | Tsai | A47B 3/04 | 108/115 |
| 8,827,386 | B1 * | 9/2014 | Kennard | A47B 77/10 | 108/48 |
| 2009/0194007 | A1 * | 8/2009 | Pearson | A47B 3/08 | 108/116 |

* cited by examiner

WORKBENCH ARRANGEMENT ADAPTED TO BE IN PART SUPPORTABLE BY A WHEELIE BIN

FIELD OF THE INVENTION

This invention relates to a unique easy to construct, though sturdy and stable temporary workbench and more particularly to a stable and temporary workbench arrangement that can utilise the inherent construction of a conventional wheelie bin in order to provide the main structural support of the workbench.

BACKGROUND DISCUSSION OF THE INVENTION

While there are rooms, sheds, laboratories and other similar type premises that have purposely built workbenches in place to be used as required, in many instances it would be advantageous to be able to construct more temporary type workbenches that can easily be put together with a quick application so as to be utilised by your common tradesperson, home handyman person, gardeners and so forth.

Nonetheless by the very nature of a workbench it needs to be of significant structural integrity in order to provide the appropriate strength for particular tasks to be carried out thereupon.

For example if a conventional fold out table was used to take the place of an appropriately constructed workbench, the degree of stability and support the table provides for work to be carried out thereupon may not be adequate.

Inappropriate support structure for the table top could lead to significant injury when in use or at the very least inadvertent movement and positioning of the table when a task is being completed on the bench which may result in misalignment and damage to the work being undertaken.

While it would be possible to make available more sturdy constructions with inbuilt support legs and so forth, as is to be expected this would then make the workbench arrangement heavy, cumbersome to construct, heavy to transport and expensive to design and manufacture.

Accordingly it would be advantageous if it were possible to utilise an existing support structure that would be readily available to the tradesperson, home handyperson, gardener and so forth to be able to be used in combination with the table top of the workbench arrangement.

For example the conventional wheelie bin has inherent durability of structure, can be easily wheeled into a position and provides a configured height which would make it suitable for use as a support structure for a workbench.

Accordingly it is an object of this invention to be able to provide a stable temporary workbench which is able to utilise at least in part the conventional wheelie bin as providing the main support structure to the workbench arrangement.

Further objects and advantages of the invention will become apparent from a complete reading of the specification.

SUMMARY OF THE INVENTION

In one form of the invention there is provided a workbench arrangement adapted to be in part supportable by a wheelie bin, said arrangement including;

a worktop with a base portion, said base portion having dimensions for a frictional fit engagement with upper internal walls of a lid removed opening of a wheelie bin such that the worktop is substantially laterally fixable in the opening of the wheelie bin, said worktop further including an outer skirt adapted to rest upon a peripheral upper edge of the lid removed opening of the wheelie bin to support the worktop in an elevated flat user workable position;

a worktop table extension, wherein a first distal end of said worktop table extension is adapted to laterally join with the outer skirt of said worktop to support the worktop table extension at the first distal end in the elevated flat user workable position; and at least one support leg fastenable at an opposing second distal end of said worktop table extension, wherein the or each support leg is adapted to support the worktop table extension at the second distal end in an elevated flat user workable position.

In one embodiment the outer skirt of the worktop includes a platform to which the first distal end of the worktop table extension is adapted to rest thereupon to support the worktop table extension at the first distal end in the elevated flat user workable position.

In preference the first distal end of the worktop table extension includes a series of protrusions and/or series of slots configured to mate with a corresponding series of slots and/or series of protrusions on the outer skirt of the worktop table to laterally join and interlink the worktop and the first distal end of the worktop table extension.

In preference the first distal end of the worktop table extension includes a series of dove tail shaped protrusions and a series of dove tail shaped slots adapted to mate and laterally join together with a corresponding series of dove tail shaped protrusions and a series of dove tail shaped slots of the outer skirt of the worktop.

In a further form of the invention the outer skirt of the worktop includes a hinged arrangement with the first distal end of the worktop table extension to laterally join together the worktop and the first distal end of the worktop table extension.

An advantage of such an arrangement is that the conventional wheelie bin with its own inherent configuration of an upright tetrahedral base supported shape provides an opening to which the workbench can be rested and/or nested therein along the peripheral upper edges of the wheelie bin to which the lid has been opened and flipped back away for appropriate access.

With the tabletop supported about the upper peripheral edge of the wheelie bin then allows for the tabletop extension to be laterally joined at least along one edge of the worktop increasing the support platform on which the user is then able to work thereupon.

Advantageously the actual upward dimensions of the standard wheelie bin make it an appropriate working height for the user to then work upon the worktop and joined thereto worktop table extension.

There is no requirement of having to add to the arrangement expensive, heavy and difficult to configure thereinto heavy support legs which would have been required unless through the unique utilisation of the conventional wheelie bin to which in part becomes one of the main supportable structural features of the workbench arrangement.

In preference there is a pair of support legs, wherein each support leg is positionable at a respective corner of the second distal end of the worktop table extension.

In preference the arrangement further includes an end member for joining together the pair of support legs with the second distal end of the worktop table extension.

In preference the end member includes a top surface to which the first distal end of the worktop table extension is restable thereupon.

In preference an underside of said end member at opposing ends of said end member mates with each respective support leg through a tab extension and slot or grove arrangement.

In preference the end member includes a pair of tab extensions at each opposing end, wherein each tab extension is adapted to engage a slot or groove of an upper end of said support leg.

In preference the top surface of the end member includes a series of protrusions and/or series of slots configured to mate with a corresponding series of slots and/or series of protrusions on the second distal end of the worktop table extension to laterally join the end piece and the second distal end of the worktop table extension.

In preference the series of protrusions and/or the series of slots are a series of dove tail shaped protrusions and a series of dove tail shaped slots on each of the end member and the second distal end of the worktop table extension.

In preference each support leg is telescopically adjustable.

In preference in one embodiment of the invention the adjustability of the pair of support legs for the tabletop extension would utilise a latching mechanism working in combination with serrations.

In preference the leg support includes an upper section and a lower section, wherein the lower section is telescopically receivable into the upper section, and wherein the base section of the upper section includes a mountable height adjustment retainer that includes a length of serrations adapted to engage serrations on the lower section of the leg support, such that when the height adjustment retainer is in a closed position the lower section is fixed at a telescopic position within the upper section.

In preference the worktop outer skirt is adapted to laterally join with two or more separate worktop table extensions.

An advantage of such an arrangement is that once the worktop has been comfortably rested and support by the wheelie bin, tabletop extensions can then be laterally joined to the positioned worktop for more than just the one single side edge.

Advantageously this means that the workbench arrangement can be configured into an 'L' shape and so forth wherein one work tabletop extension can engage one side or edge of the worktop and then at an edge 90° a separate work tabletop extension can there be added and secured thereto.

In alternative embodiments tabletop extensions can be added at 180° and if necessary four separate tabletop extensions can engage each side of the worktop supported within the conventional wheelie bin providing an opportunity for the workbench arrangement to be used by more than just one person.

In preference in an alternative embodiment of the invention the engagement means between the worktop and the worktop table extension is achieved by an interleaving jointing system characterised by male and female interleaving fingers which are brought together and secured by a securing pin passed through securing pin retaining holes placed through the interleaved fingers of the interleaved joining system.

In preference the base portion includes a series of fins for frictional fit engagement with the upper internal walls of the lid removed opening of the wheelie bin such that the worktop is substantially laterally fixable in the opening of the wheelie bin.

In preference the worktop includes a hinged top plate raiseable to allow access into the wheelie bin.

In an alternative embodiment the worktop includes a lid or cover, said lid or cover adapted to slide over a hollow chute of said worktop, wherein said hollow chute is adapted to provide access into the wheelie bin.

An advantage of such an arrangement is that albeit the worktop is supported and secured along the peripheral upper edge of the wheelie bin, access to the bin to allow rubbish, debris and so forth to be placed therein can be achieved simply through the hinged flap or platform and/or the slot arrangement wherein either way the user can conveniently access the wheelie bin to dump rubbish therein without having to pull the worktop from its comfortable frictional fit engagement with the wheelie bin.

In preference the arrangement further includes a small to large wheelie bin adaptor, such that a lid removed opening of a smaller wheelie bin is convertable to a lid removed opening of a large wheelie bin by the small to large wheelie bin adaptor.

In preference the workbench arrangement further includes a storage compartment adapted to laterally engage the worktop or the worktop table extension.

Advantageously the conventional worktop arrangement can be further utilised using the same lateral engagement mechanism between the worktop and/or the worktop table extension where the same engagement means can be positioned along one of the edges of the storage compartment so it can readily joined as required to the workbench arrangement.

In preference the arrangement further includes a tool rack configured to laterally engage either the worktop and/or the table top extension.

The dimensions of the worktop, workbench and accessories is such that they can fit within a dedicated wheelie bin for transport and storage In an alternative embodiment, the worktop and workbench will be in two parts each secured by a hinge that will allow the worktop and workbench to fold laterally down the middle reducing the width dimension of the worktop and workbench so the embodiments of such arrangements can be stored inside the wheelie bin.

By way of example only, a preferred embodiments of the invention are described more fully hereafter, with reference to the accompanying Figures, in which:

In order now to describe the invention in greater detail a series of preferred embodiments will be presented with the assistance of the following illustrations and accompanying text.

DETAILED DESCRIPTION OF THE DRAWINGS

Figure 1:
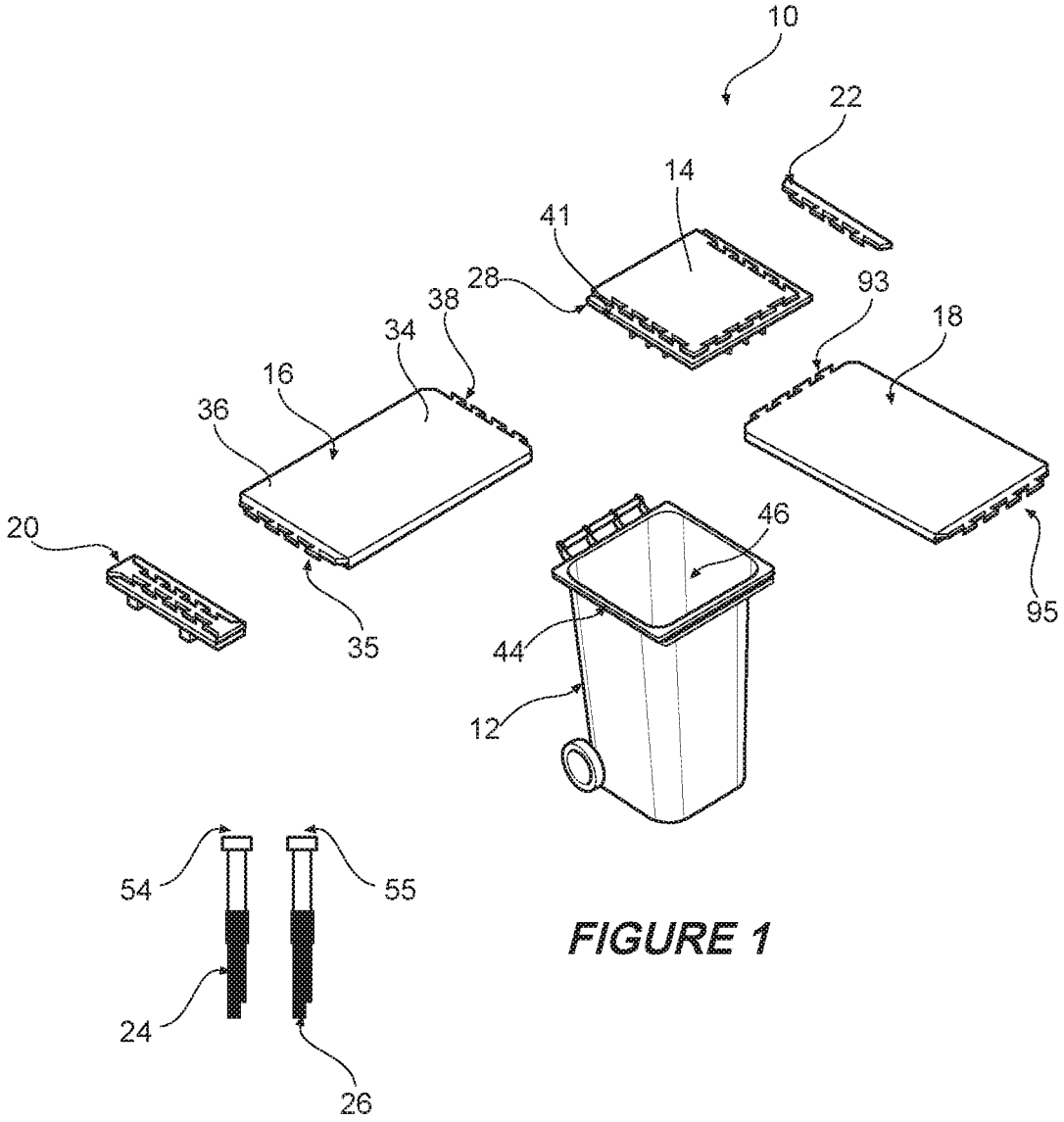
FIG. 1 is a perspective view of the components making up the workbench arrangement in a preferred embodiment of the invention.

Referring to the drawings now in greater detail, notably firstly to FIGS. 1 to 7, wherein shown in FIG. 1 is a workbench arrangement (10) for a preferred embodiment of the invention.

The workbench arrangement (10) includes a wheelie bin (12) to which the worktop (14) is able to nest there inside the opening (46) of the wheelie bin (12) with the lid (not shown) of the wheelie bin retracted away from the opening (46).

Figure 2:
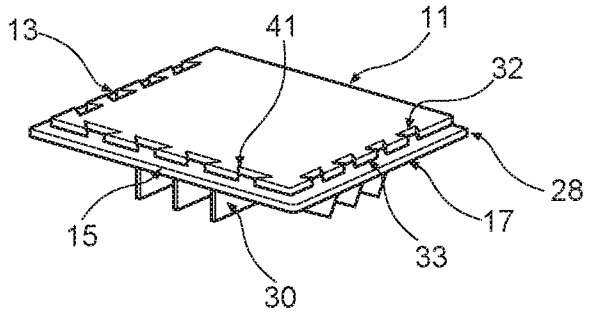
FIG. 2 is a perspective view of the worktop of the workbench arrangement in a preferred embodiment of the invention.

With the opening (46) of the wheelie bin (12) available the worktop (14) through the use of the fins (30) at the base portion of the worktop (14), as best seen in FIG. 2, is able to frictionally engage the upper internal walls of the wheelie bin (12).

The worktop (14) includes an outer skirt (28) which is able to be supported by the peripheral upper edge (44) of the lid removed opening of the wheelie bin (12).

Accordingly the worktop (14) is able to be laterally fixed in place within the opening (46) of the wheelie bin (12) through the frictional engagement of the base portion fins (30) of the worktop (14) and then be mounted and supported in the elevated flat user-workable position due to the outer skirt (28) of the worktop (14) being adapted to rest upon the peripheral upper edge (44) of the wheelie bin (12).

The worktop table extensions (16) and (18) are able to engage sides (13) and (17) respectively of the worktop (14) through the unique dovetail end configurations.

The worktop table extension (16) at each of its respective first distal end (34) and second distal end (36) have corresponding series of dovetail protrusions and slots (31) and (35) wherein the series of dovetail slots and protrusions (31) at the first distal end (34) of worktop table extension (16) are able to rest upon the platform (41) of the worktop (14) outer skirt (28) to then be laterally joined in an interlocking engagement with the corresponding series of dovetail slots and protrusions of the worktop (14).

In the general embodiment shown, side (17) of the worktop (14) also engages an additional worktop table extension (18) thereby providing an 'L' shaped configured workbench arrangement (10).

As with the worktop table extension (16) worktop table extension (18) includes at each of its distal ends a series of dovetail protrusions and slots (93) and (95) which are adapted to mate with a corresponding series of slots and protrusions on the worktop (14) for a lateral interlocking engagement between the worktop (14) and the worktop table extension (18).

For clarity reasons the worktop table extension (18) does not show the leg support assembly which would be the same as that represented in relation to the pair of leg support assemblies (24) and (26) shown for worktop table extension (16) to support the other end of the worktop table extension (18).

The pair of support leg assemblies (24) and (26) engage an end piece (20) wherein the corresponding slots (57) and (59) of each of the leg support assemblies (24) and (26), are able to engage protrusions (54) and (56) on the end piece (20).

The upper platform (51) along with the corresponding series of dovetail protrusions and slots allows the second distal end (36) of the worktop table extension (16) to rest and be laterally interlocked with the end piece (20) and accordingly thereby supported thereby with the pair of support leg assemblies (24) and (26).

Figure 5:
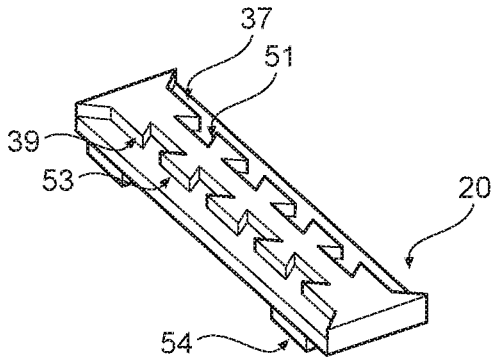
FIG. 5 shows a preferred embodiment of the end piece linking together the pair of support legs with the worktop table extension in a preferred embodiment of the invention.

The end piece (20) on the non-engaging side with the worktop table extension (16) has an additional platform (53) and series of protrusions and dovetail slots (39) as best seen in FIG. 5, which allows for a further lateral extension of the workbench arrangement with an additional worktop table extension.

For example, if the workbench wanted to increase its workable area then an additional worktop table extension could then join the other side of the end piece (20) and that additional worktop table extension (not shown) could laterally extend the arrangement further on to which such a further worktop table extension would itself again be supported by an end member (20) and corresponding leg support assembly arrangements (24), (26).

Figure 16:
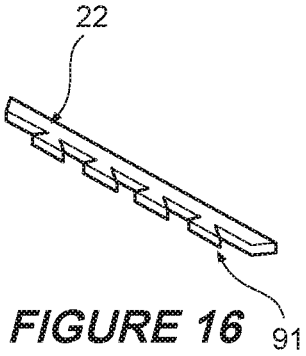
FIG. 16 shows a perspective view of the closing end piece of the workbench arrangement in a preferred embodiment of the invention.

As also shown in the general worktop arrangement (10) of FIG. 1 there is a closing end piece (22) which has its own corresponding series of dovetail protrusions and slots (91), as best seen if FIG. 16, which are able to mate with the corresponding series of dovetail protrusions and slots on side (15) of the worktop (14).

In the embodiment shown in FIG. 1 side (11) of the worktop aligns itself with the handle arrangement of the wheelie bin.

FIG. 2 shows a perspective view of the worktop arrangement also represented in FIG. 1. As shown in greater detail the worktop (14) includes three potentially engaging sides (13), (15) and (17) and the non-engaging side (11) adapted to be aligned with the handle of the wheelie bin.

The worktop includes the outer skirt (28) which will allow the worktop (14) to rest upon the upper peripheral edge of the wheelie bin but also then provides the platform (41) to which the distal ends of the worktop table extensions will be able to rest thereupon and then to allow the corresponding dovetail protrusions (33) and slots (32) of the worktop (14) to interlink laterally with those of the worktop table extensions.

The base portion of the worktop (14) includes a series of fins (30) which allow the worktop to frictionally or robustly resiliently engage with the upper internal edges of the opening of the wheelie bin so as to laterally fix the worktop in place for it then to be mounted and supported about the peripheral upper edge (44) of the opening (46) of the wheelie bin (12).

Figure 3:
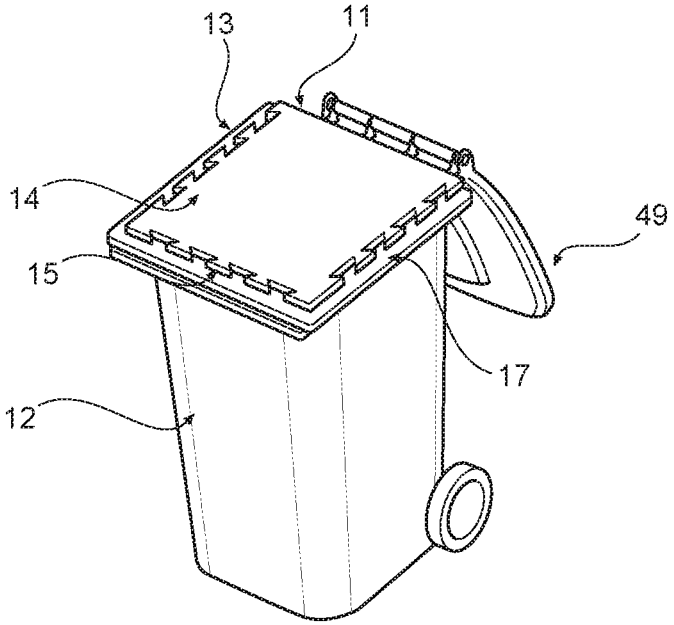
FIG. 3 shows a perspective view of the worktop fitted to an opening of a wheelie bin in a preferred embodiment of the invention.

FIG. 3 shows a perspective view of the conventional wheelie bin (12) with the worktop table (14) positioned therein with the lid (49) of the wheelie bin (12) withdrawn or levered open so that an opening can be provided for the wheelie bin (12) to allow the worktop bench (14) to be positioned therein.

Figure 4:
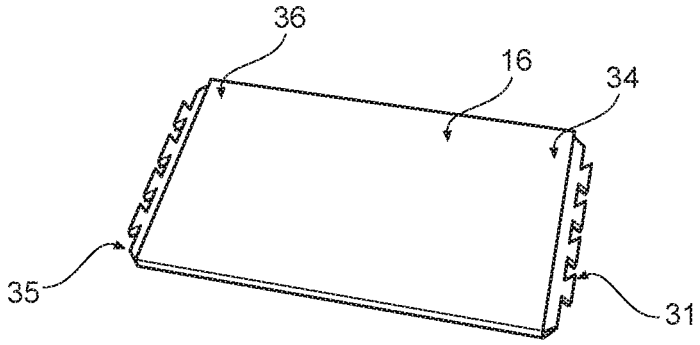
FIG. 4 shows a perspective view of the worktop table extension in a preferred embodiment of the invention.

FIG. 4 shows the worktop table extension referenced in FIG. 1 in greater detail showing the series of dovetail protrusions and slots (31) and (35) which allow the worktop table extension at the first distal end (34) to be able to actually interlock and be joined with the worktop (14) and thereby being supported by the wheelie bin while at the second distal (36) end being able to engage the end member (20) thereby being supported by the pair of leg support assemblies (24) and (26).

As discussed above, generally in relation to FIG. 1 but in greater detail shown in FIG. 5, the end piece (20) provides a means in which the pair of leg support assemblies (24) and (26) can engage with the worktop table extension (16).

The end piece (20) includes on its upper surface, platforms (51) and (53) which each has a corresponding series of dovetail protrusions and slots (37) and (39) which are able to laterally mate and interlock with a corresponding series of dovetail slots and protrusions of the worktop table extensions.

At the base of the end piece (20) there is a pair of tab extensions (54) and (56) which are able to engage the corresponding slots (57) and (55) at the top of each leg support assembly (24) and (26), which will be discussed in greater detail in relation to FIG. 6.

Figure 6:
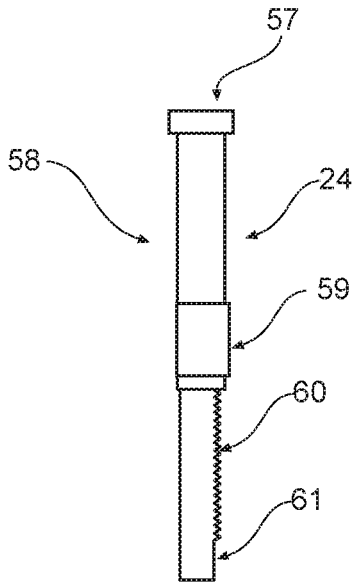
FIG. 6 shows a side view of an adjustable leg support assembly of the workbench arrangement in a preferred embodiment of the invention.

FIGS. 6 through to 15 illustrate various aspects of the leg support assembly (24) shown in FIG. 1.

Shown generally in FIG. 6, the leg support assembly (24) includes an upper section (58) which as best seen in FIGS. 8, 9, 10, 11 and 12 includes tetrahedral column which is able to support a leg adjustment retainer (59).

At the top of the upper section of the workbench arrangement is a slot shown by way of (57) which is able to engage the corresponding protrusion (56) extending out from the base of the end piece (20).

Figure 14:
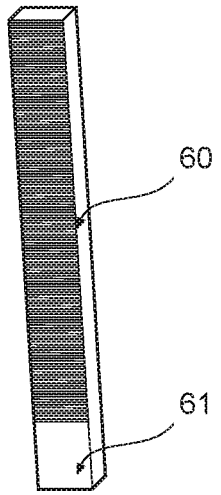
FIG. 14 shows a perspective view of the lower section of the leg support assembly of the workbench arrangement in a preferred embodiment of the invention.

The leg support assembly (24) also includes a lower leg section (61) which as best seen in FIG. 14 includes a series of serrations (60).

Figure 13:
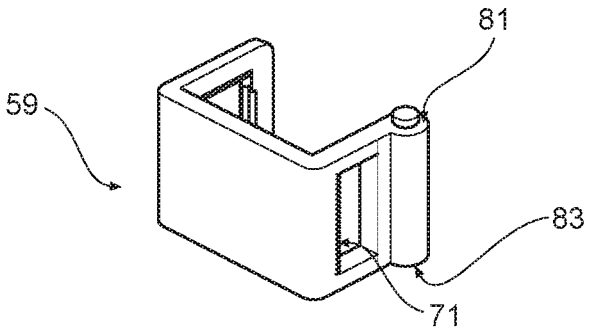
FIG. 13 shows a perspective view of the support leg assembly leg height adjustment retainer.
Figure 15:
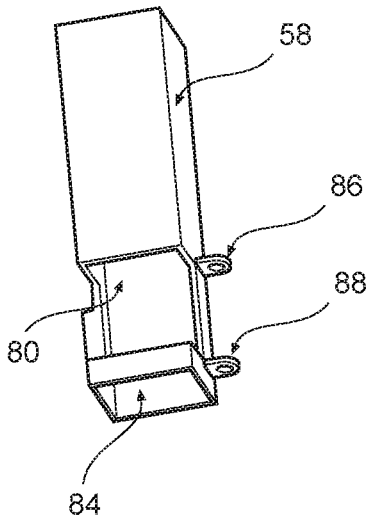
FIG. 15 shows a perspective view of part of the upper section of the support leg assembly of the workbench arrangement in a preferred embodiment of the invention.

As best understood when referencing the support leg height adjustment retainer (59) in the embodiment shown in FIG. 13, the leg height adjustment retainer (59) includes also a series of serrations (71) and once the leg height adjustment retainer (59) is supported in the upper section (58) of the leg support assembly (24) the ratchet type serration engagement between the serrations (60) on the lower section (61) of the leg support assembly (24) with those serrations (71) of the support leg height adjustment retainer (59) allows the lower leg section (61) to be telescopically received into the hollow chamber (84) as best seen in FIG. 15 of the upper section (58) of the leg support assembly (24).

With the leg height adjustment retainer (59) mounted through features (81) and (83) of the leg height adjustment retainer (59) by the supports (86) and (88) on the upper section (58) of the leg support assembly (24) within the opening (80) provides a convenient adjustment mechanism so that the leg support assembly (24) can be locked in at a desirable adjustable height.

Figure 7:
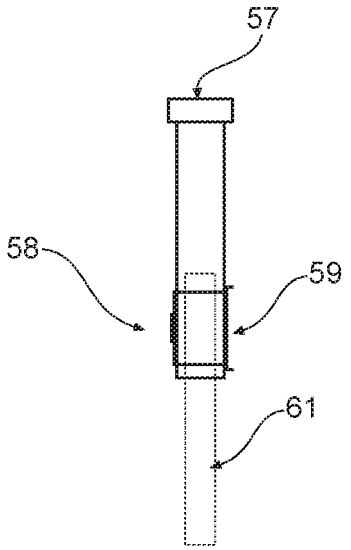
FIG. 7 is a similar representation of the leg support assembly of FIG. 6 with some sections removed and a part shown as a cutaway view for greater clarity.

In FIG. 7 the lower section (61) of the leg support assembly (24) has been shown in broken lines just to introduce some clarity so there is an understanding as to how the lower section (61) may be telescopically received in the upper section (58) of the leg support assembly (24) as the corresponding serrations (60) of the lower section (61) of the leg assembly (24) engage with the serrations (71) of the leg height adjustment retainer (59).

Figure 8:
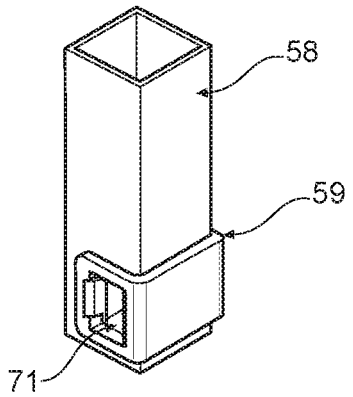
FIG. 8 shows a left side perspective view of the upper section of the leg support assembly of the workbench arrangement including the leg height adjustment retainer for a preferred embodiment of the invention.
Figure 9:
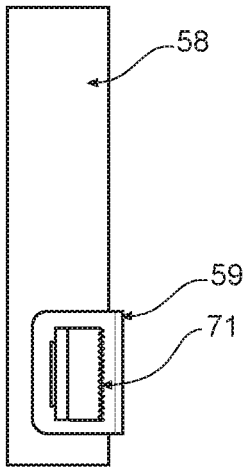
FIG. 9 shows a left side view of the preferred embodiment shown in FIG. 8.
Figure 10:
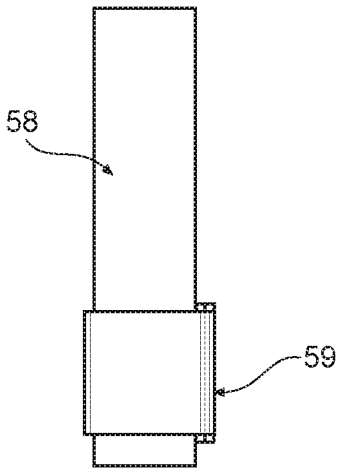
FIG. 10 shows a front view of the preferred embodiment shown in FIG. 8.
Figure 11:
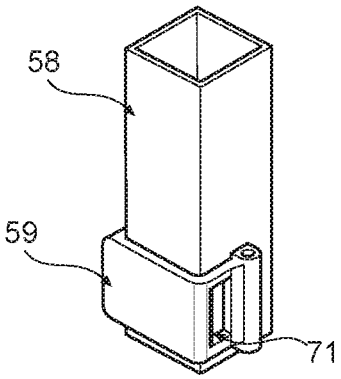
FIG. 11 shows a perspective view of the right hand side of the embodiment shown in FIG. 8.
Figure 12:
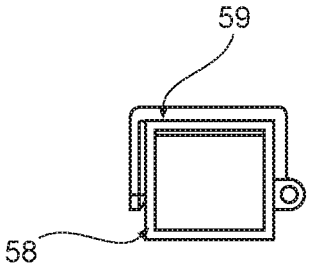
FIG. 12 shows a top view of the preferred embodiment shown in FIG. 8.

FIGS. 8 through to 12 show the leg height adjustment retainer (59) in the closed position mounted to the upper section (58) of the leg support assembly (24).

FIG. 16 shows the closing end piece (22) which through a series of dovetail protrusions and slots (91) is configured to fit on the edge of a side of the worktop not laterally engaged in an interlocking join with a worktop table extension.

As is to be expected the preferred embodiment shows the lateral interlocking mating relationship completed by a series of dovetail shaped protrusions and slots but as the person skilled in the art will appreciate there is a whole range of shapes that can be considered for interlocking the relative lateral joints of the pieces of this invention and accordingly there is no intention in describing in the preferred embodiment the dovetail series of slots and protrusions to limit the invention to just such a single embodiment.

Figure 17:
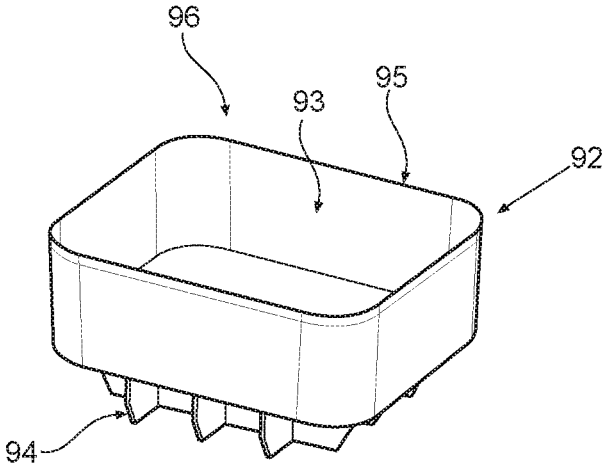
FIG. 17 shows a perspective view of a large wheelie bin to small wheelie bin adapter of the workbench arrangement in a preferred embodiment of the invention.

FIG. 17 shows a perspective view of the large wheelie bin to small wheelie bin adapter (92) that is used on smaller versions of wheelie bins to ensure that a level workbench is achieved and that the overall support height of the worktop arrangement will not be different depending on whether a small or large wheelie bin is employed.

The large wheelie bin to small wheelie bin adapter (92) will still include at its base portion a series of fins (94) which will be able to frictionally engage the internal walls of the upper opening of the wheelie bin but the side extension (95) means that the vertical height when the worktop engages the internal walls (93) and the general opening (96) will be the same as that to be expected from a large wheelie bin.

Figure 18:
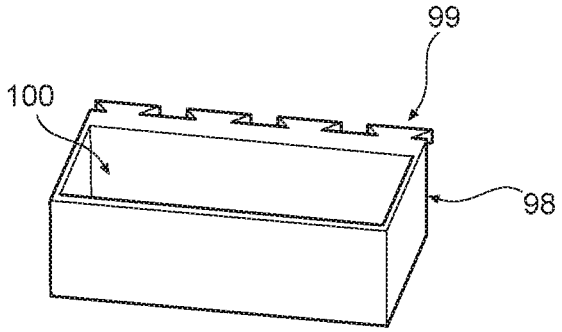
FIG. 18 shows a perspective view of a storage caddy as part of the workbench arrangement in a preferred embodiment of the invention.

FIG. 18 shows a perspective view of a storage caddy (98) which through the series of dovetail protrusions and slots (99) is adapted to engage with the series of dovetail protrusions and slots of other components of the workbench arrangement. The storage caddy (98) includes an open chamber (100) wherein articles can be stored. The storage caddy (98) represents an example of the many kinds of different optional devices that can be fitted to the workbench arrangement of this invention.

Figure 19:
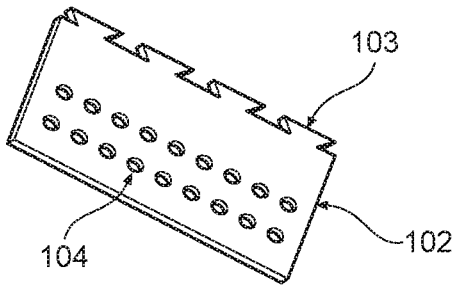
FIG. 19 shows a perspective view of a tool rack as part of the workbench arrangement in a preferred embodiment of the invention.

FIG. 19 shows a further such example wherein a tool rack (102) is provided wherein once again the series of dovetail protrusions and slots (103) is configured to laterally join and interlock with other such components in the workbench arrangement and wherein the series of apertures (104) provide an opportunity where tools can be supported within the tool rack (102).

Figure 20:
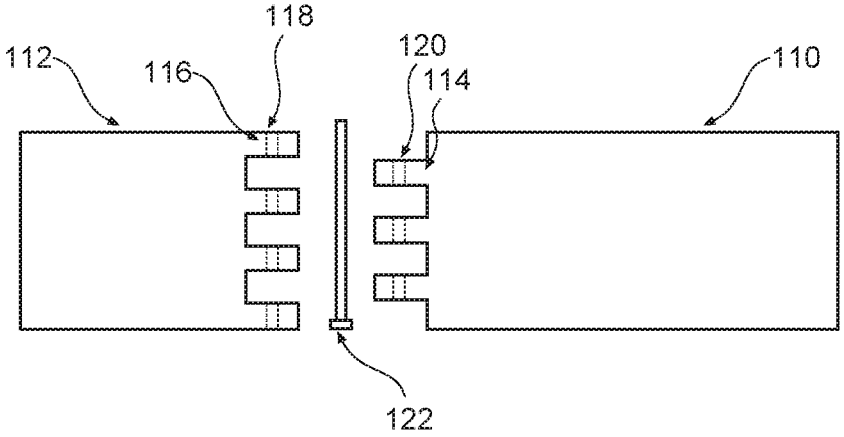
FIG. 20 shows a top view of a further preferred embodiment of the joining together of a worktop with a worktop table extension.

FIG. 20 shows a further preferred embodiment of the invention wherein the worktop (112) can be laterally interlinked with a worktop extension (110) wherein the lateral interlocking joint is formed by an interleaving jointing system characterised by male and female interleaving fingers (116) and (114) wherein the bringing together of the interleaving fingers (116), (114) allows for channels (118) and (120) to define a single path through which the hinge pin (122) can pass there through to laterally interlink and lock the respective worktop (112) and the worktop table extension (110).

Figure 21:
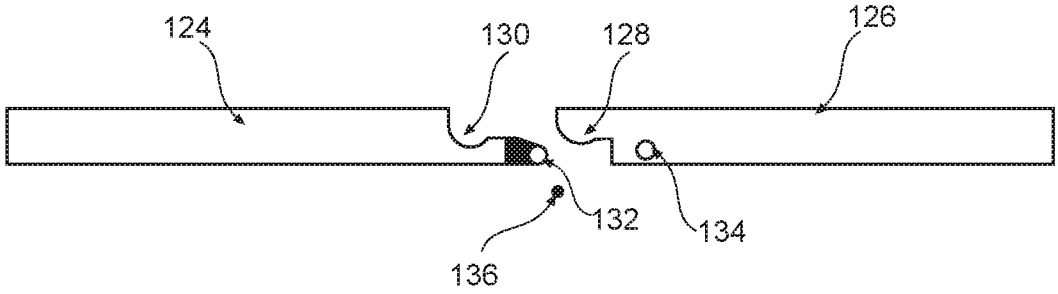
FIG. 21 shows a further preferred embodiment of a joining together arrangement of the worktop and the worktop table extension.

FIG. 21 shows a further preferred embodiment of a method of joining together a worktop (124) and a worktop table extension (126) where the joint is formed by an interleaving jointing system characterised by a curved protrusion (128) and corresponding groove (130) which allows the protrusion (128) to rest in the groove (130) so as to align the pin holes (132) and (134) to allow the pin (136) to be inserted therein in order to laterally interlock and fix the worktop (124) with the worktop table extension (126).

Figure 22:
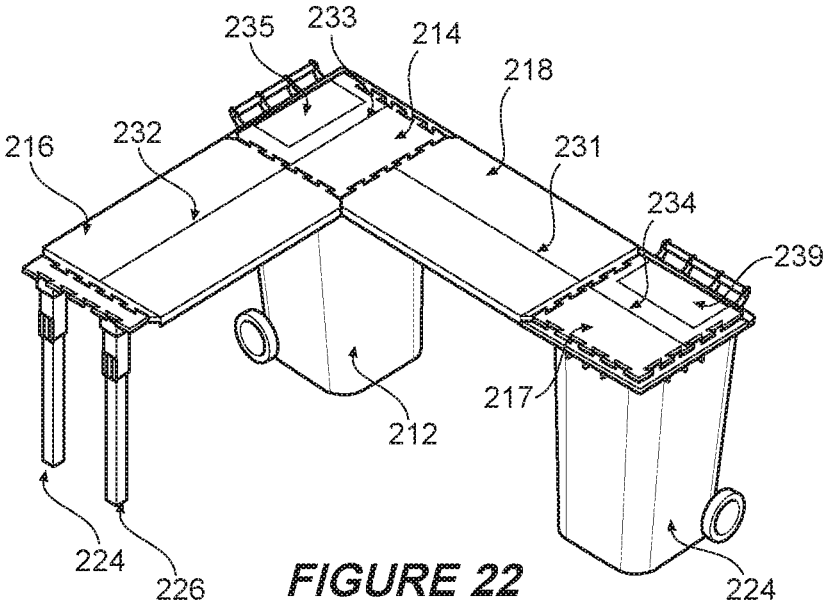
FIG. 22 shows a perspective view of a further preferred embodiment of the invention where two wheelie bins are incorporated as part of the workbench arrangement.

In FIG. 22 a further preferred embodiment of the invention is shown wherein not only is there the central wheelie bin (212) supporting the workbench arrangement but an additional wheelie bin (224).

In the embodiment shown in FIG. 22 rather than having only the pair of leg support assemblies (224) and (226) providing at one end support for the worktop table extension (216), in the case of worktop table extension (218) it is supported at one end by the wheelie bin (212) and at the other end by the second wheelie bin (224).

In the embodiment in FIG. 21 shown there is also a series of hinged fold lines (231) and (232) for the respective worktop table extensions (218) and (216) as well as folded hinge lines (233) of the worktop (214) and folded hinge line (234) of worktop (217) wherein each of these folded hinge lines (234), (231), (233) and (232) allow that corresponding component to be folded up and collapsed as required so it can be more conveniently then placed and stored within the convention wheelie bin if need be.

Also by being able to fold up the pieces making up the workbench arrangement will allow for easier storage, transport and handling of the workbench arrangement.

Also shown is that the worktops (214) and (217) can include a lid shown as (235) and (239) which can be opened up to allow access into the wheelie bin as required by the user.

The invention claimed is:

1. A workbench arrangement adapted to be in part supportable by a wheelie bin, said arrangement including;

a worktop with a base portion, said base portion having dimensions for a frictional fit engagement with upper internal walls of a lid removed opening of a wheelie bin such that the worktop is substantially laterally fixable in the opening of the wheelie bin, said worktop further including an outer skirt adapted to rest upon a peripheral upper edge of the lid removed opening of the wheelie bin to support the worktop in an elevated flat user workable position;

a worktop table extension, wherein a first distal end of said worktop table extension is adapted to laterally join with the outer skirt of said worktop to support the worktop table extension at the first distal end in the elevated flat user workable position;

a pair of support legs fastenable at an opposing second distal end of said worktop table extension, wherein each support leg of the pair of support legs is positionable at a respective corner of the second distal end of the worktop table extension, wherein each support leg of the pair of support legs is adapted to support the worktop table extension at the second distal end in the elevated flat user workable position;

an end member adapter to join together the pair of support legs with the second distal end of the worktop table extension, the end member including a top surface to which the second distal end of the worktop table extension is restable thereupon; and a pair of tab extensions at each opposing end of the underside of the end member, wherein each tab extension is adapted to engage a slot or groove of an upper end of said support leg of the pair of support legs, and wherein the top surface of the end member is configured to mate with the second distal end of the worktop table extension through the interaction of slots and protrusions to laterally join the end piece and the second distal end of the worktop table extension.

2. The workbench arrangement of claim 1 wherein the outer skirt of the worktop includes a platform to which the first distal end of the worktop table extension is adapted to rest thereupon to support the worktop table extension at the first distal end in the elevated flat user workable position.

3. The workbench arrangement of claim 2 wherein the first distal end of the worktop table extension is configured to mate with the outer skirt of the worktop table through the interaction of slots and protrusions to laterally join the worktop and the first distal end of the worktop table extension.

4. The workbench arrangement of claim 3 wherein the first distal end of the worktop table extension includes a series of dove tail shaped protrusions and a series of dove tail shaped slots adapted to mate and laterally join together with a corresponding series of dove tail shaped protrusions and a series of dove tail shaped slots of the outer skirt of the worktop.

5. The workbench arrangement of claim 4 wherein the outer skirt of the worktop includes a hinged arrangement with the first distal end of the worktop table extension to laterally join together the worktop and the first distal end of the worktop table extension.

6. The workbench arrangement of claim 1 wherein the protrusions dove tail shaped protrusions and the slots are dove tail shaped slots provided on each of the end member and the second distal end of the worktop table extension.

7. The workbench arrangement of claim 1 wherein each support leg is telescopically height adjustable.

8. The workbench arrangement of claim 7 wherein each support leg includes serrations serving to make them telescopically height adjustable.

9. The workbench arrangement of claim 8 wherein each leg support includes an upper section and a lower section, wherein the lower section is telescopically receivable into the upper section, and wherein a base section of the upper section includes a mountable height adjustment retainer that includes a length of serrations adapted to engage serrations on the lower section of the leg support, such that when the height adjustment retainer is in a closed position the lower section is fixed at a telescopic position within the upper section.

10. The workbench arrangement of claim 1 wherein the worktop outer skirt is adapted to laterally join with two or more separate worktop table extensions.

11. The workbench arrangement of claim 1 wherein the base portion of the worktop includes a series of fins for frictional fit engagement with the upper internal walls of the lid removed opening of the wheelie bin such that the worktop is substantially laterally fixable in the opening of the wheelie bin.

12. The workbench arrangement of claim 1 wherein the worktop further includes a lid to allow access into the wheelie bin.

13. The workbench arrangement of claim 1 wherein the arrangement further includes a small to large wheelie bin adaptor, such that a lid removed opening of a smaller wheelie bin is convertable to a lid removed opening of a large wheelie bin by the small to large wheelie bin adaptor.

14. The workbench arrangement of claim 1 wherein the workbench arrangement further includes a storage compartment adapted to laterally engage the worktop or the worktop table extension.

15. The workbench arrangement of claim 1 wherein the arrangement further includes a tool rack configured to laterally engage either the worktop or the table top extension.

* * * * *